US007472623B2

(12) United States Patent
LaPointe

(10) Patent No.: US 7,472,623 B2
(45) Date of Patent: Jan. 6, 2009

(54) POLYPROPYLENE RECLINER HANDLE WITH LOCKING MEANS

(75) Inventor: Larry P LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 563 days.

(21) Appl. No.: 11/041,615

(22) Filed: Jan. 24, 2005

(65) Prior Publication Data

US 2006/0179968 A1 Aug. 17, 2006

(51) Int. Cl.
*G05G 1/04* (2006.01)

(52) U.S. Cl. ..... 74/523

(58) Field of Classification Search ..... 74/557, 74/488, 543, 544, 519, 523; 403/373, 374.2; 16/421, 422, 427

See application file for complete search history.

(56) References Cited

U.S. PATENT DOCUMENTS 909,035 A * 1/1909 Stuart ..... 411/315
3,111,861 A 11/1963 Young
3,400,446 A * 9/1968 Yulkowski ..... 29/463
4,756,523 A 7/1988 Rasmussen
4,896,558 A * 1/1990 Meier et al. ..... 74/543
5,282,395 A 2/1994 LaPointe et al.
6,164,102 A * 12/2000 Gapco ..... 70/408
6,648,357 B2 11/2003 Hotch
2003/0040749 A1 2/2003 Grabowski et al.

FOREIGN PATENT DOCUMENTS

FR 2636557 A1 * 3/1990

OTHER PUBLICATIONS

International Search Report issued in corresponding PCT Application No. PCT/US06/00387.

* cited by examiner

*Primary Examiner*—Vicky A Johnson
(74) *Attorney, Agent, or Firm*—Harness, Dickey & Pierce, P.L.C.

(57) ABSTRACT

A detachable operator assembly for a recliner chair including a handle, a drive rod and a threaded fastener. The handle is configured to operably connect with the drive rod without requiring a metal insert or reinforcement. The threaded fastener is inserted into a counterbore formed in the handle such that the shank freely passes through the handle and threadingly engages the drive rod. The shank extends through the drive rod to threadingly engage the handle. The operator assembly is configured so that the fastener fails before the plastic handle fails, and more specifically, so the fastener breaks between the fastener head and the drive rod, thereby allowing easy removal of the broken fastener without disassembly of the drive rod from the reclining chair.

12 Claims, 2 Drawing Sheets

POLYPROPYLENE RECLINER HANDLE WITH LOCKING MEANS

FIELD OF THE INVENTION

The present invention relates to a handle for attaching to a rotatable drive rod, and more specifically to a handle located on the exterior of a recliner-type chair and secured to a rotatable drive rod to operate various features and mechanisms of the recliner chair.

BACKGROUND OF THE INVENTION

Recliner chairs come in a variety of shapes and sizes. For example, some chairs have a rocking mechanism, some chairs have extendible footrests, while other chairs have seats and seat backs that move from a normal upright position to a reclined position. While a given recliner chair can possess these features in various combinations, most recliner chairs commonly share the need to provide a handle or manual operator by which the user can select and control various chair positions and mechanisms. The recliner handle, because it must be easily accessible by the user, is typically located along the lower lateral portion of the chair below the armrest.

Prior known handles typically have a metal insert that is molded within the handle so that only the collar portion and set screw bore of the insert are accessible. The handle is attached to the drive rod by inserting the protruding end of the drive rod into a complimentary shaped bore within the insert, and a set screw is tightened against a corner of the square drive rod to secure the handle to the chair.

One drawback of prior known handles is the increased manufacturing costs associated with molding a metal insert within the recliner handle. Another drawback of prior know handles is the set screw that is used to retain the drive rod. Specifically, the set screw does not provide an adequate locking means to prevent the drive rod from loosening when seated in a bore, nor does the set screw prevent the drive rod from rotating within the bore. It is therefore desirable to provide a recliner handle without a metal insert molded within the handle in order to reduce manufacturing costs while maintaining durability to sustain extended periods of use without breaking, bending, loosening, or rotating.

SUMMARY OF THE INVENTION

The present invention provides an operator assembly including a handle without a metal insert molded within the handle in order to reduce manufacturing costs, while maintaining durability to sustain extended periods of use without breaking, bending, loosening, or rotating. The present invention provides an operator assembly for engaging a drive rod of a recliner chair wherein the drive rod is rotated to operate a mechanism associated with the recliner chair such as a retractable footrest mechanism or the like. The operator assembly includes a handle having a body with a first end and a second end allowing for easy grasping, a drive rod, and a threaded fastener insertable into the drive rod. The handle is operable to receive the rotatable drive rod which is interconnected to a linkage mechanism. The first end of the handle includes a counterbore having a clearance hole. The clearance hole is adapted to receive a threaded fastener. The first end further includes a cavity configured to receive the drive rod, and a slot extending from the square-shaped cavity opposite the counterbore. The threaded fastener having a lead-in is insertable into clearance hole and extends through a threaded bore of the drive rod and engages with the slot.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

The preferred embodiment of the present invention is directed toward an operator assembly 10 of a recliner-type chairs. These recliner-type chairs typically have mechanisms for, among other things, extending and retracting a footrest, reclining and returning the seat back to an upright position, and/or operating various lock out mechanisms which may permit or prevent the chair body from traveling along a track toward a tilted position, or permit or prevent the chair body from rocking. Many recliner chairs with such mechanisms include a drive rod 20 to which a mechanism actuation handle 12 is attached. By sitting in the chair and rotating the handle 12 clockwise or counterclockwise, the user can operate one or more of the chair mechanisms. An example of a recliner chair incorporating various of such mechanisms and an associated drive rod is set forth in U.S. Pat. No. 5,301,413 issued on Apr. 12, 1994, entitled "Modular Reclining Chair and Method," and owned by the assignee of the present invention. Another example of such a recliner chair is set forth in U.S. Pat. No. 5,271,660 issued on Dec. 21, 1993, entitled "Reclining Sofa," and owned by the assignee of the present invention. The aforementioned references are incorporated by reference; however due to the well-known nature of such types of recliner chairs and/or sofas the associated mechanisms and drive rod will not be described in detail herein except to the extent necessary to provide an understanding of the present invention.

Figure 1:
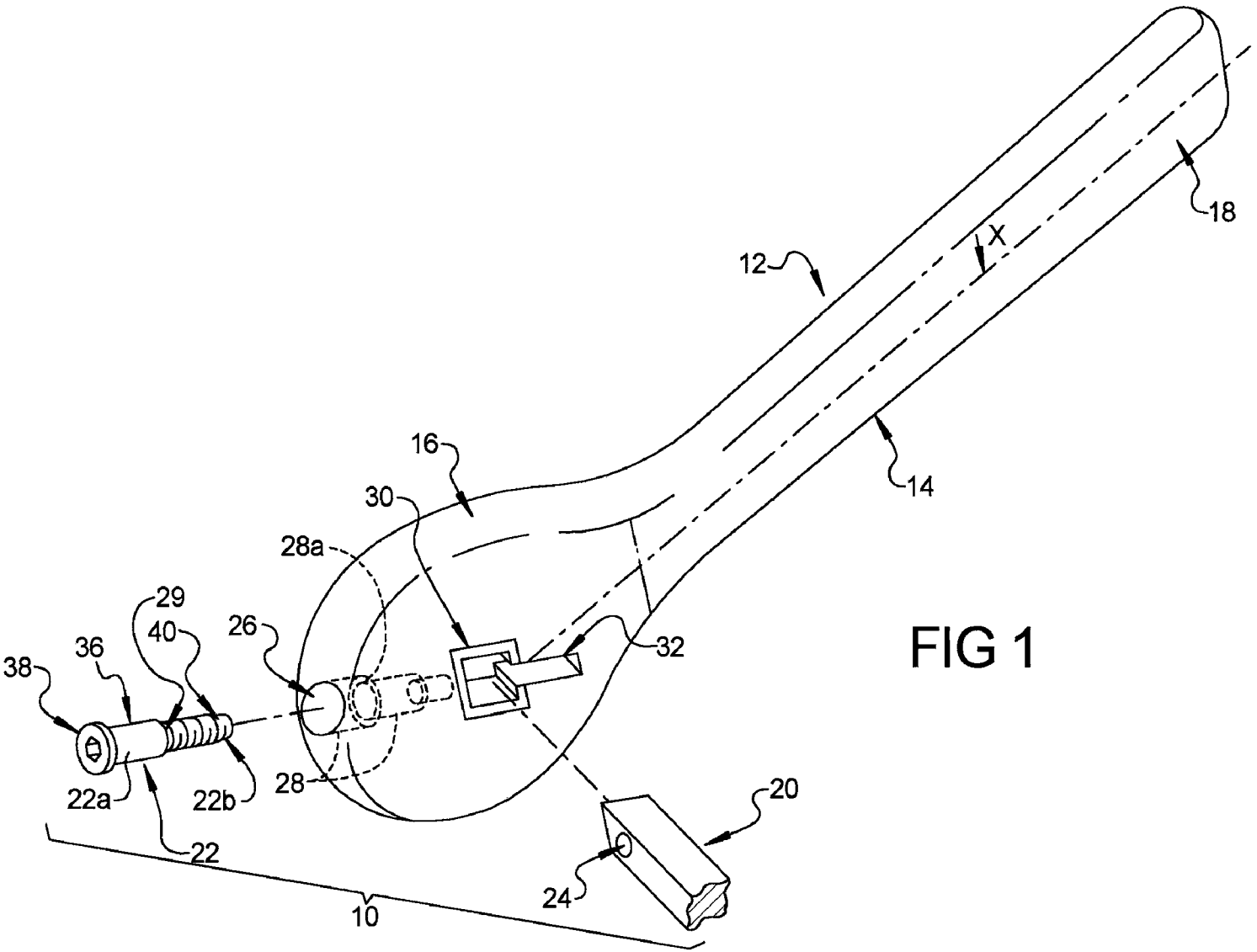
FIG. 1 is a perspective view of the preferred operator assembly of the present invention.
Figure 2:
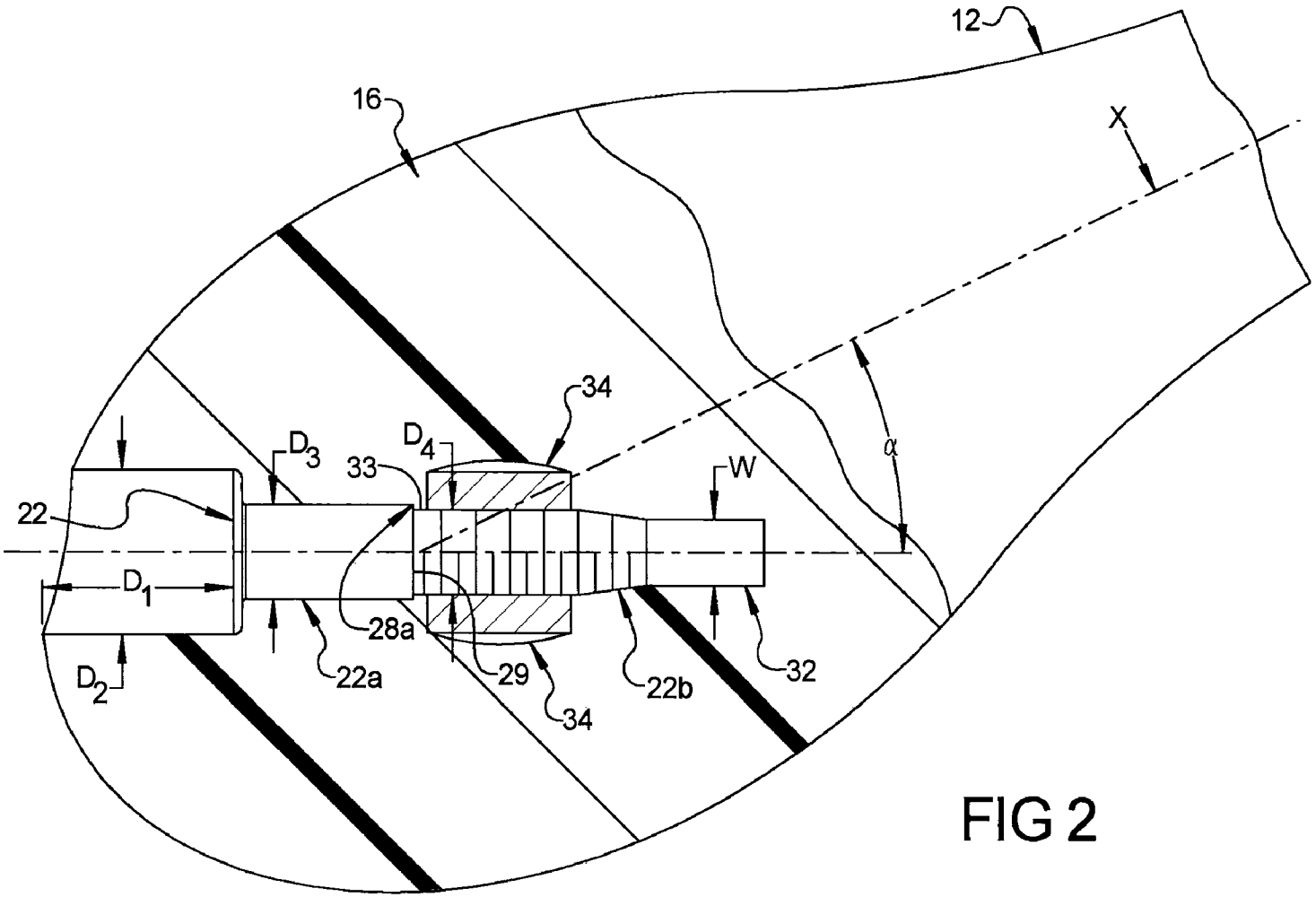
FIG. 2 is a cross sectional view of the first end of the handle of the assembly shown in FIG. 1 showing the drive rod received by the square shaped cavity of the handle coupled together by a threaded fastener.

Referring to FIGS. 1 and 2, the operator assembly 10 of the present invention is adapted to control various features and mechanisms of a recliner chair. The operator assembly 10 includes a handle 12 with a hub 16 and a grip 18 extending from hub 16 allowing for easy grasping, a drive rod 20, and a threaded fastener 22 insertable into the drive rod 20. Handle 12 is operable to receive rotatable drive rod 20 which is operably interconnected to a linkage mechanism. As presently preferred, the drive rod 20 is generally square in cross-section defining a flat surface with an aperture or bore 24 at the end of the drive rod 20. The hub 16 of handle 12 includes a counterbore 26 having a clearance hole 28. The clearance hole 28 is adapted to receive threaded fastener 22. The face of the hub 16 further includes a square shaped cavity 30 configured to receive drive rod 20, and a slot 32 extending from square-shaped cavity 30.

In its preferred form, threaded fastener 22 includes a shoulder portion 22*a* on the shank and clearance hole 28 is a stepped bore for receiving having a first diameter sized to receive the fastener head and a second diameter sized to receive the shoulder portion. The clearance hole 28 terminates at a flange 28*a* which engages the cheek 29 of the shoulder portion 22*a* to provide a definite stopping point for tightening the threaded fastener 22. Threaded fastener 22 also includes a lead-in portion 22*b* which is received into clearance hole 28,extends through threaded bore 24 of drive rod 20 and engages with slot 32. In this preferred configuration, the shoulder portion 22*a* in conjunction with the stepped bore helps to prevent distortion of the plastic handle during installation.

The handle 12 is preferably made of polypropylene which provides a flexible plastic material that withstands breaking and cracking when large loads are applied to the handle 12. This is advantageous as it prevents the handle 12 from breaking or cracking before the threaded fastener 12. Stated another way, the failure mode of the assembly 10 is such that the fastener 22 will break at a point 33 between the counterbore 26 and the square-shaped cavity 30, rather than the handle 12 breaking.

The advantages of the present invention can be better appreciated by referring to FIG. 2. The hub 16 of handle 12 includes square-shaped cavity 30. An axis "y" defined by counterbore 26 clearance hole 28, square-shaped cavity 30 and slot 32 is angled slightly by an offset angle relative to a longitudinal axis "x" of the handle 12. As presently preferred, the angle is generally 25 degrees. The square-shaped cavity 30 is adapted to receive drive rod 20. The sides 34 of the square-shaped cavity 30 are outwardly bowed at the midpoints of the square. This is advantageous as it allows the drive rod 20 to locate within the corners of the square-shaped cavity 30 and seat securely in the handle 12 without rotating from side to side. Thus, a positive coupling is achieved between the handle 12 and the drive rod 20. Counterbore 26 having a depth "D1" and a diameter "D2" is perpendicular to the square-shaped cavity 30. Clearance hole 28 having a diameter of "D3" is concentric with counterbore 26. The counterbore 26 allows the head of the threaded fastener 22 to be hidden within handle 12 and minimizes the length of the threaded fastener 22 needed. The clearance hole 28 allows threaded fastener 22 to be inserted through the handle 12 and self-tap into the drive rod 20. This is advantageous because when the threaded fastener 22 self-taps through the drive rod 20 the handle 12 is pulled up against the adjacent face of the drive rod 20. In this manner, a portion of the handle 12 is directly clamped between the head of fastener 22 and the flat surface of the drive rod 20. As shown in FIG. 2, the drive rod 20 and handle 12 are interconnected by inserting threaded fastener 22 into clearance hole 28 and mating threaded fastener 22 with bore 24 of drive rod 12. After threading through the bore 24 of drive rod 20, threaded fastener 22 extends into slot 32 of handle 12. Slot 32 having an opening in width "w" smaller than a diameter "D4" of threaded fastener 22 allows slot 32 to act as a thread lock to prevent unwanted loosening of the fastener 22. In addition, this configuration gives the assembly 10 more rigidity to prevent deformation of the plastic by the metal when rotating the handle 12.

In the preferred embodiment, it is desirable to have a threaded fastener 22 that will break off at the head side 38 before it breaks off at the lead-in side 40 of the fastener 22. Specifically, the fastener will fail at the interface between the drive rod 20 and handle 12 in the square cavity 30. In this way, the threaded fastener 22 may be easily removed with pliers without having to remove the drive rod from the chair. Thus, an important aspect of the present invention is the relationship between the fastener length, fastener diameter, and the diameter of the slot 32 of handle 12. The length of threaded fastener 22 extending from drive rod 20, the diameter of the threaded slot 32 in handle 12, and the major and minor diameter of the threaded fastener 22 are used to provide this desired failure mode. With reference to FIG. 1, threaded fastener 22 preferably is an M7×30 mm fastener, as the M7×30 m fastener matches the desired length to diameter ratio.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An operator assembly for use in a reclining chair, the operator assembly comprising:

a drive rod having a rod end with a flat surface and an aperture formed through said rod end and said flat surface;

a handle having a cavity formed in a side thereof to receive said rod end and a stepped bore formed in a handle end perpendicular to and through said cavity;

a slot extending from said cavity in said handle, said slot and said stepped bore having a common axis;

a fastener having a head and a shank, said shank having an unthreaded shoulder portion and a threaded portion with a cheek created between said shoulder portion and said threaded portion, said fastener inserted into said handle end such that said shank is positioned freely through said stepped bore and said threaded portion is threadingly received in said aperture to threadingly engage said drive rod, said fastener further threadingly engages with said slot; and said stepped bore defining a clearance hole terminating at a flange operating as a stopping point for said cheek of the fastener;

wherein a portion of said handle is directly clamped between said head and said flat surface of said drive rod.

2. The operator assembly of claim 1 further comprising a counterbore portion of said stepped bore, wherein when said threaded portion threadingly engages said drive rod, a portion of said handle is directly clamped between said shoulder portion and said flat surface of said drive rod defining a failure mode point for breaking said fastener located between said counterbore and said cavity, such that said fastener will break before said handle will break.

3. The assembly of claim 2 wherein said slot has a width which is less than a threaded portion diameter of said shank to create a thread lock, and said slot is created through a plastic material of the handle adapted to receive said threaded portion.

4. The operator assembly of claim 1 wherein said handle comprises polypropylene.

5. The operator assembly as set forth in claim 1 wherein said cavity comprises a square-shaped cavity.

6. The operator assembly as set forth in claim 5 wherein a sidewall of said square-shaped cavity adjacent said bore is outwardly bowed at a midpoint thereof.

7. The operator assembly as set forth in claim 1 wherein said fastener is self-tapping.

8. An operator assembly for use in a reclining chair, the operator assembly comprising:

a square drive rod having a rod end with a flat surface and a threaded aperture formed completely through the rod end and the flat surface;

a fastener having a head and a shank, the shank including a shoulder portion having a shoulder diameter smaller than a head diameter, a threaded portion extending from the shoulder portion opposite the head, and a flange defining a cheek between the shoulder portion and the threaded portion;

a handle having a square cavity adapted to slidingly receive the rod end, and a stepped bore created perpendicular to and into the cavity adapted to be aligned with the threaded aperture of the drive rod, the stepped bore including:

a first diameter adapted to slidingly receive the head; and a second diameter smaller than the first diameter, the second diameter adapted to slidingly receive the shank, the second diameter defining a clearance hole terminating at a flange defined by the second diameter, the flange operating as a stopping point for the cheek of the fastener;

the handle further including a slot extending from the cavity coaxial with and opposite to the bore;

the head of the fastener received in the first diameter when the shoulder portion is received in the second diameter and the cheek is in contact with the flange, the threaded portion of the fastener being threadingly engaged with the threaded aperture and the threaded portion extending through the threaded aperture to further threadingly engage the slot.

9. The handle assembly of claim 8 further comprising:

a hub portion of said handle, said handle extending from said hub portion at a first axis; and the stepped bore defining a second axis with respect to the first axis;

wherein said first axis is angularly offset with respect to said second axis by an angle in the range of about 10° to about 45°.

10. The operator assembly of claim 8 wherein said slot has a width less than a diameter of said shank of said threaded portion.

11. The operator assembly of claim 8 wherein said threaded fastener comprises a self-tapping fastener having a lead-in portion of said threaded portion, said lead-in portion extending into said slot.

12. The operator assembly of claim 8 wherein said handle consists essentially of a polypropylene handle.

* * * * *